United States Patent [19]

Levin et al.

[11] 3,963,071

[45] June 15, 1976

[54] CHELL-AND-TUBE HEAT EXCHANGER FOR HEATING VISCOUS FLUIDS

[76] Inventors: Evgeny Sergeevich Levin, ulitsa Sofiiskaya, 48, korpus 3, kv. 129; Vladimir Andreevich Permyakov, 2 Murinsky prospekt, 10, kv. 116, both of Leningrad; Nikolai Vasilievich Zozulya, ulitsa Reiterskaya, 30, kv. 6, Kiev; Igor Yakovlevich Shkuratov, ulitsa Semashko, 21, kv. 152, Kiev; Boris Leonidovich Kalinin, Muzeiny pereulok, 2, kv. 9, Kiev; Boris Fedorovich Vakulenko, ulitsa P. Tolyatti, 14, kv. 49; Pavel Ivanovich Podgorochny, ulitsa P. Tolyatti, 20, kv. 61, both of Taganrog, all of U.S.S.R.

[22] Filed: June 14, 1974

[21] Appl. No.: 479,590

[52] U.S. Cl. ..... 165/142; 165/106

[51] Int. Cl.[2] ..... F28D 7/12

[58] Field of Search ..... 165/142, 158–161, 165/106, 148

[56] References Cited

UNITED STATES PATENTS

| | | | |
|---|---|---|---|
| 1,738,914 | 12/1929 | Mott | 165/142 |
| 2,049,748 | 8/1936 | Rathbun | 165/161 X |
| 2,267,695 | 12/1941 | Graham | 165/142 |
| 2,611,584 | 9/1952 | Labus | 165/142 X |
| 3,229,761 | 1/1966 | Ware | 165/142 |

FOREIGN PATENTS OR APPLICATIONS

| | | | |
|---|---|---|---|
| 120,450 | 1959 | U.S.S.R. | 165/142 |

*Primary Examiner*—Charles J. Myhre
*Assistant Examiner*—T. Streule
*Attorney, Agent, or Firm*—Haseltine, Lake & Waters

[57] ABSTRACT

A shell-and-tube heat exchanger for heating viscous fluids, in particular, for heating liquid fuel in thermal power stations, comprising a shell with external tubes located therein which contain heating elements constructed in the form of internal tubes plugged at one end and auxiliary tubes contained therein for supplying a heating medium to the heating elements, the viscous fluid flowing between the external and the internal tubes, tube plates for fixing the external and internal tubes to the shell, and partitions for dividing the bundle of external tubes into sections, the number of external tubes in each section being different and proportional to the viscosity of the heated fluid flowing in the appropriate section.

6 Claims, 6 Drawing Figures

CHELL-AND-TUBE HEAT EXCHANGER FOR HEATING VISCOUS FLUIDS

The invention relates to the field of thermal engineering, ship building, petrochemical and food industires, and more particularly to pipe-housing heat exchangers for heating viscous fluids.

It is known that for heating a viscous fluid, e.g. fuel oil, use is made of shell-and-tube heat exchangers featuring multiple-pass circuits of viscous fluids along smooth straight or U-shaped tubes fastened to the tube plates of the shell and uniformly distributed (according to the number of tubes) over the sections (channels) formed by the shell partitions. In this case, the heating medium, e.g. steam, is supplied to the intertube space of the shell.

There are known also heat exchangers of the "tube-in-tube" type wherein viscous fluid flows in narrow annular channels formed by tubes concentrically arranged one within another, the internal tube being provided with longitudinal or transverse fins for increasing the heat-transferring area, and the heating medium flowing in the internal tube. These heat exchangers consist of one or several sections interconnected by means of branch pipes.

Known are heat exchangers of the tube-in-tube type wherein the supply of the heating medium for heating the surface of the internal tube, the annular channel and the viscous fluid flowing therein is accomplished through an auxiliary tube located within the internal tube, the internal tube itself being plugged at one end. The auxiliary tube is open at the other end in the area where the internal tube is plugged. Such heating elements, i.e. the plugged internal tube with the auxiliary tube, disposed therein, open at one end, are positioned inside a single external shell tube, i.e. they form heat exchangers of the tube-in-tube type, or they are placed into a shell body common for several heatng elements, the heated viscous fluid being supplied to the inter-tube space to provide a longitudinal or a transverse flow of viscous fluid around the tube bundle of the heating elements, use being made of special flat partitions located in the inter-tube space of the tube bundle of the heating elements.

For the purpose of providing directional movement of the viscous fluid at a pre-determined speed along the surface of the heating elements, use is also made of round external tubes concentrically surrounding the heating elements which, in turn, can be fixed in the tube plates at the ends of the shell body. The external tubes, the tube plates and the shell of the heat exchanger form an additional chamber whereto a medium can be supplied to heat the viscous fluid on two sides in the annular concentric channel formed by the internal tube, the heating element, and the external tube (see e.g. the USSR Inventor's Certificate No. 61,702).

The disadvantages common for the heat exchangers used as heaters of viscous fluids (e.g. fuel oil by steam), mentioned above are as follows: considerable overall dimensions and metal consumption due to low intensity of heat transfer to the flow of viscous fluid, poor withdrawal of condensate from the heating elements, high hydraulic resistance, possible loss in tightness of the rolled-in tube-to-plate connections and, as a result, contamination of the heating steam condensate by the viscous fluid being heated, and difficulty in dismantling the heat exchanger for cleaning purposes.

An object of the present invention is to provide such a shell-and-tube heat exchanger that ensures higher efficiency of heating; provision for an easy dismantling for cleaning; a design that eliminates contamination of the condensate of the heating steam by the viscous fluid, and to provide a better withdrawal of the condensate from the heating elements.

This object is accomplished in a shell-and-tube heat exchanger comprising a shell with external tubes located therein and accommodating heating elements constructed in the form of internal tubes plugged at one end, with auxiliary tubes located inside for supplying heating medium to the heating elements. The viscous fluid flows between the external and internal tubes. There are furthermore tube plates for fastening the external and internal tubes to the shell, and partitions dividing the bundle of external tubes into sections wherein each section, according to the invention, has a different number of external tubes whose number is proportional to the viscosity of the heated fluid flowing in the appropriate section.

It is suggested that each auxiliary tube, supplying the heating medium inside the respective heating elements be plugged at one end, and the lower portions be provided with heating medium outlets arranged at an angle of 60°–80° to the generatrix of the auxilliary tube and directed oppositely to the plug.

The shell-and-tube heat exchanger of the invention is suitable for heating any viscous fluids including fuel oil and petroleum products by steam being condensed. Employed in the heat exchanger is a rational layout of double-sided heat supply to the flow of viscous fluid in the concentric clearance of smooth or longitudinally finned tubes heated both from the outside and the inside.

The principal advantages of the proposed shell-and-tube heat exchanger are listed below:

1. high reliability, no contamination of heating steam condensate and environment with fuel oil or petroleum products as a result of employing welding for joining the pipes to the tube plates at a self-compensating temperature of the internal heating elements;
2. high intensity of heat transfer and low hydraulic resistance with double-sided heat supply to the flow of viscous fluid in the channel between the two concentrically arranged heating tubes; and
3. convenient maintenance and repairs provided by the flange connection of the shell body, allowing the tube bundle of the heating elements to be removed.

The proposed shell-and-tube heat exchanger for heating viscous fluid has undergone commercial testing in the systems for heating liquid fuel at a thermo-electric power station.

The commercial operation has proved the aforementioned advantages of the shell-and tube heat exchangers under consideration as compared with the heat exchangers used earlier for the same purpose.

The following specifications are characteristic of the inventive shell-and tube heat exchangers for heating viscous fluids when utilized as heaters of liquid fuel at thermo-electric power stations:

type of device - shell-and-tube, horizontal or vertical, welded sectionalized;

heating medium — steam ($P \leq 25$ kgf/cm$^2$; $t_n \leq 300°C$)

heated viscous fluid — fuel oil, petroleum products;

consumption of fluid being heated — 15 - 240 t/h;
temperature of fluid being heated — 50°—150°C;
pressure of fluid being heated — up to 64 kgf/cm²;
material of pipes and housing — carbon steel.

The electric arc welding method is used to join the pipes to the tube plates.

The invention is further illustrated by a detailed description of a specific, exemplary embodiment with reference to the accompanying drawings, wherein.

Figure 1:
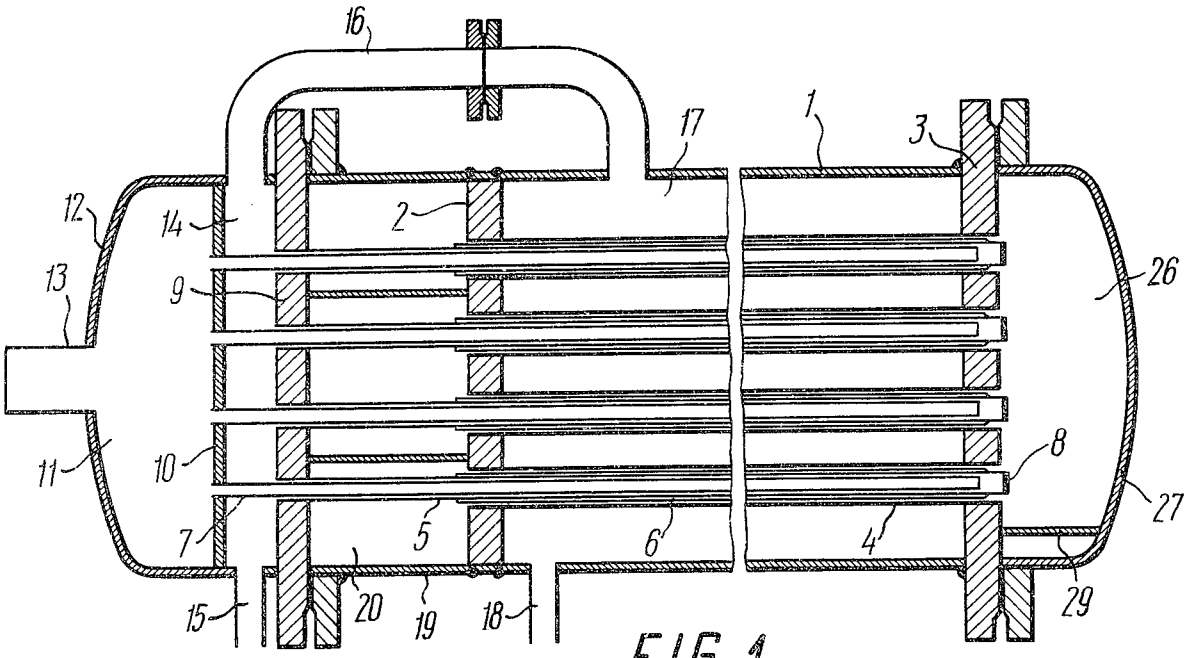
FIG. 1 is a longitudinal section of a shell-and-tube heat exchanger according to the invention for heating viscous fluids.

The shell-and-tube heat exchanger for heating viscous fluids (FIGS. 1 and 2) comprises a shell 1 having front 2 and rear 3 tube plates to which external tubes 4 are welded by means of the electric arc method. Internal tubes 5 are concentrically installed therein for increasing the surface of heat transfer, and they have external longitudinal fins 6. Additional or auxiliary tubes 7 are also located concentrically with the internal tubes 5. The internal and the auxiliary tubes 5, 7 form the heating elements. The internal tubes 5 are each plugged with a plug 8 and are fastened to tube plates 9 by means of mechanical rolling and electric welding.

The auxiliary tubes 7 are connected to a header plate 10 dividing the steam chamber into two parts. The left lower part 11 of the steam chamber is formed by a bottom plate 12 of the heat exchanger with a steam branch pipe 13 for supplying the heating medium, and the right part is formed by the header plate 10, a short cylindrical shell 14 or reciever chamber of the shell 1 and the tube plate 9. Installed in the lower left part 11 of the steam chamber is a branch pipe 15 used to drain condensate therefrom, and in the upper part is a duct 16 used to admit steam to a main chamber 17 formed by the inter-tube space in of the heat exchanger shell 1. A branch pipe 18 is intended to drain condensate from the lower part of the inter-tube space 17.

A front chamber 20 for viscous fluids divided by partitions 21 (FIG. 2), 22 and 23 into sections from the first to the sixth according to the number of channels of the viscous fluid, is formed by the tube plates 2 and 9 together with a shell ring 19 of the 1.

The inlet section I is connected to a branch pipe 24 for supplying viscous fluid (the direction of supply is indicated by the arrow in FIG. 2), and the outlet section VI is connected to a branch pipe 25 delivering the heated viscous fluid from the heat exchanger.

Figure 2:
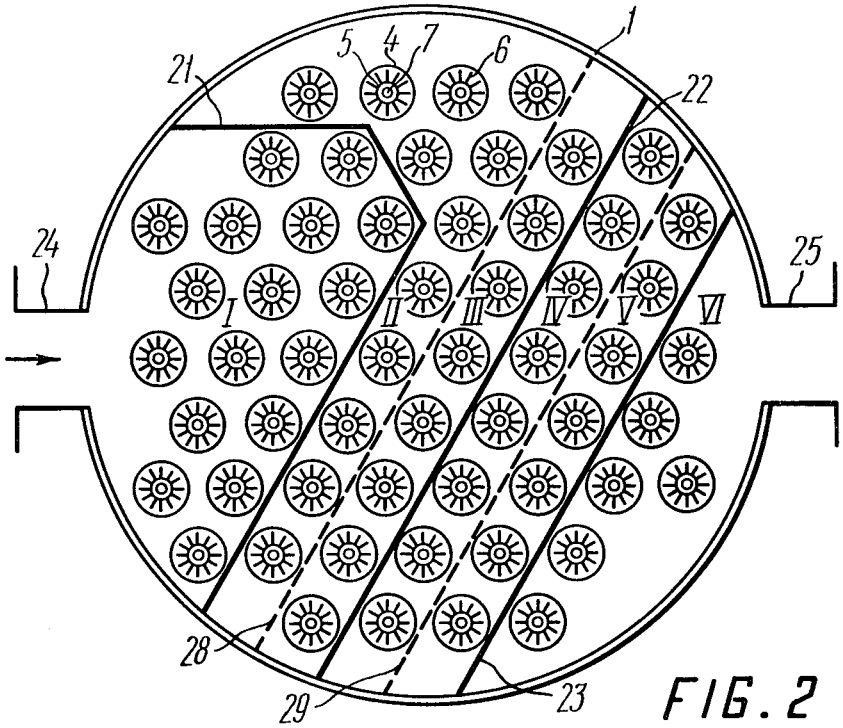
FIG. 2 is a cross-section along the axis lines of the branch pipes for supplying the viscous fluids.

An intermediate chamber 26 (FIG. 1) is formed by a right-hand bottom plate 27 and the tube plate 3. The intermediate chamber 26 is divided by partitions 28 (FIG. 2) and 29 into sections which correspond to the arrangement of the partitions 21, 22 and 23 (FIG. 2) in the front chamber 20. The arrangement of the partitions 21, 22 and 23 as shown in FIG. 2 is selected so that with a multiple-pass viscous-fluid circuit in annular clearances between the concentrically located tubes 4 and 5, the cross-sectional area for the passage of the viscous fluid changes, i.e. decreases in proportion to the reduction in viscosity of the heated fluid.

Figure 4:
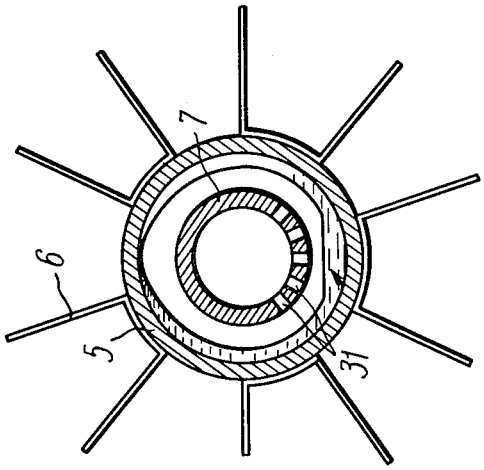
FIG. 4 is a section along line IV—IV of FIG. 3.
Figure 3:
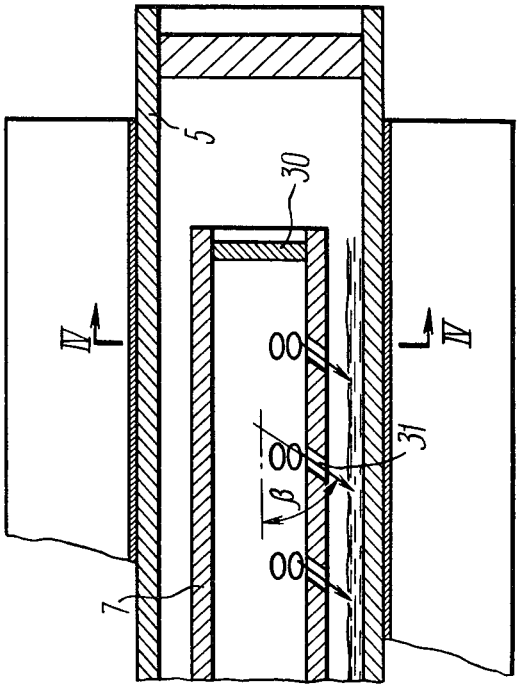
FIG. 3 is a longitudinal section of the internal and additional tubes of the heating elements.

The auxiliary tubes 7 (FIG. 3) contain plugs 30 and openings 31 (FIGS. 3 and 4) located lengthwise in the lower portion of these tubes 7. The axes of the openings 31 are inclined with respect to the axis of the auxiliary tube 7 at an angle of $\beta$=60°–80° and are inclined away from the plug 30 (FIG. 3).

Figure 5:
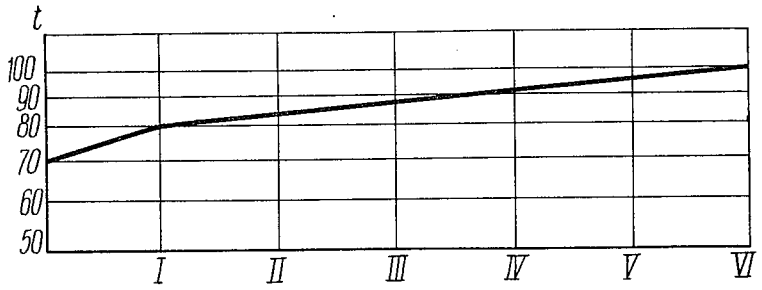
FIG. 5 is a diagram of temperature variation of viscous fluid (fuel oil "M-100" Grade) according to the sections (channels) of the heater.
Figure 6:
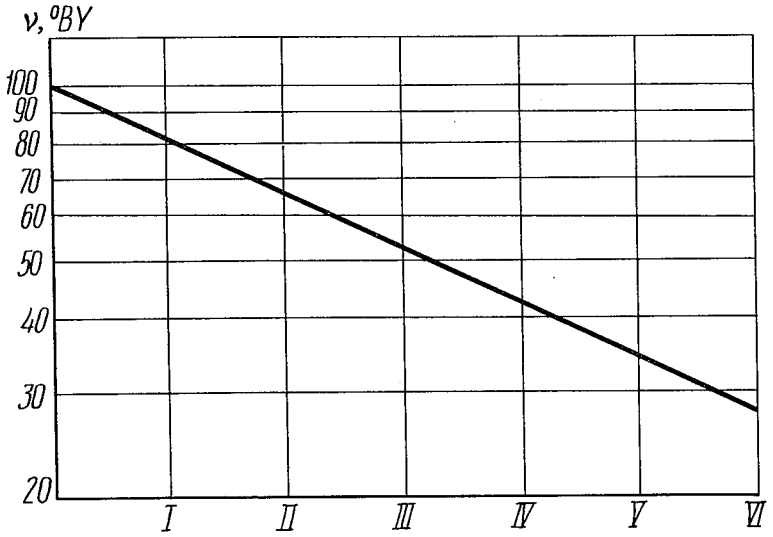
FIG. 6 is a diagram for the variation of the kinematic viscosity of the same fuel oil according to the sections (channels) of the heater.

The operation of the heat exchanger is illustrated by diagrams for a variation of temperature t of the viscous fluid (fuel oil of the M-100 Grade taken as an example) along the length of the heated tubes (passages) in FIG. 5, and for the variation of viscosity $v$ of the fluid associated with the flow temperature and the movement of fluid within the heated tubes in FIG. 6. The notations in the diagrams are as follows:

$t$ = temperature of the viscous fluid (fuel oil M-100), deg.;

$v$ = kinematic visosity of the same fuel oil, deg. of conditional viscosity;

I to VI = respective fluid passages corresponding to the first through sixth sections.

The heat exchanger device operates in the following manner: the heating medium, i.e. steam proceeds through the branch pipe 13 (FIG. 1) to the left part 11 of the steam chamber and further through the auxiliary tubes 7 to the internal tubes 5, to be distributed therein. The heating steam is partially condensed on the internal surface of the tubes 5 that are cooled by the viscous fluid. The steam condensate proceeds from the lower portion of the internal tubes 5 to the lower part 14 of the steam chamber 14 wherefrom it escapes from the heat exchanger shell 1 through the branch pipe 15.

Since in the lower portion of the auxiliary tubes 7 there are provided the openings 31, inclined to the flow of the condensate, the steam passing through these openings produces a dynamic pressure on the condensate film, making the condensate leave the annular clearance at a high speed between the internal tubes 5 and the auxiliary tubes 7. In this case, the intensity of heat transfer of the heating steam is increased and the temperature of the wall of the internal tube 5 is raised.

The steam proceeds from the upper part of the steam chamber 14 through the duct 16 to the inter-tube space 17 of the heat exchanger shell 1 wherein it transfers the heat to the external tubes 4, is completely condensed and is discharged through the branch pipe 18.

With a view to improving the withdrawal of the condensate from the internal tubes 5, and its drainage from the surfaces of the external tubes 4, it is expedient that the longitudinal axis of the heat exchanger be inclined at an angle of 2° to 5° with respect to the horizontal in the inter-tube space 17 of the shell 1.

The viscous fluid to be heated in the heat exchanger proceeds through the branch pipe 24 (FIG.2) to the first inlet section I of the front chamber 20, separated by the partition 21 (FIG.2) from the remaining portion of the chamber. From the first inlet section the viscous fluid proceeds to the annular clearances between the internal and the external tubes 5,4, the number of these clearances being determined in the first inlet and the subsequent sections or passages as was stated above, in accordance with the variation of viscosity when heating the fluid.

The internal tube 5 has an increased surface due to the provision of the longitudinal fins 6, transferring heat to the viscous fluid flowing in the space between the pipes 4 and 5. Heat is also transferred to the flow of fluid by the external tubes 4.

This is the way the viscous fluid is heated in the first passage wherefrom it proceeds to the intermediate chamber 26 and therefrom to the tubes of the second section or passage II and so on until it comes out of the heat exchanger. A considerable increase in the speed of the viscous fluid in the passages following the first one and an increase in the heat transfer intensity corresponding to the speed increase are provided by a reduction of the passage areas of the annular clearances between the tubes 4 and 5.

The increase in speed of the viscous fluid in the channels following the first one contributes to a decrease in the amount of sediments on the surfaces of the pipes, since it is known that the amount of sediments tends to grow as the heating of the viscous fluid is increased the heated viscous fluid is removed from the heat exchanger through the branch pipe 25.

To illustrate this, FIG. 5 shows a diagram for the variation of temperature of the M-100 Grade viscous fuel oil used as energy-producing fuel and heated in the shell-and-tube heat exchangers of the type described above when it is prepared to be burned in steam generators. Temperature t of the flow is set off along the ordinate axis. The number of the fluid passages or sections is set off on the abscissa axis.

FIG. 6 represents a decrease in kinematic viscosity by 3.5 times when heating the M-100 Grade fuel oil from 70 to 100 deg. Centigrade. According to the variation of viscosity shown in FIG. 6, the number of tubes and the velocity of fuel oil for the predetermined flow rate through the heat exchanger is distributed over the sections and passages as is shown in the following table.

| Number of fluid section or passage | Ratio $\bar{v}_i/\bar{v}_l$ | Number of pipes in channel, pieces | Velocity of fuel oil, m/sec. |
|---|---|---|---|
| I | 1 | 17 | 0.7 |
| II | 0.80 | 12 | 0.99 |
| III | 0.65 | 9 | 1.32 |
| IV | 0.50 | 8 | 1.49 |
| V | 0.42 | 7 | 1.7 |
| VI | 0.34 | 6 | 2.38 |

where $\bar{v}_i$ = average viscosity in the $i^{th}$ channel;

$\bar{v}_l$ = average viscosity in the first channel.

What is claimed is:

1. A heat exchanger for heating a viscous fluid by a heating medium, the heat exchanger comprising:

a shell;

a plurality of external tubes distributed within said shell and extending longitudinally therewithin;

heating elements in said external tubes, including internal tubes disposed within respective ones of said external tubes to form first clearance spaces therewith, and additional tubes disposed within said internal tubes to form second clearance spaces therewith;

first and second plug means respectively closing said internal and said additional tubes at one of the ends thereof;

plate means securing said external tubes, said internal tubes and said additional tubes within said shell to form a receiver chamber, a front chamber, a main chamber, and an intermediate chamber;

means for introducing the heating medium into said additional tubes, whereby the medium traverses the latter;

said additional tubes being provided with outlet means adjacent said second plug means to permit the heating medium to flow into said second clearance spaces;

said receiver chamber being open to said second clearance spaces; a discharge outlet for condensate in said receiver chamber at the bottom thereof;

means for conveying the heating medium from said receiver chamber, at the top thereof, to said main chamber;

inlet means for supplying the viscous fluid to said front chamber;

said intermediate chamber being open to said first clearance spaces at the end thereof;

partition means in said front and said intermediate chambers, defining successive sections therein for causing the viscous fluid to flow from said front chamber to said intermediate chamber via said first clearance spaces while traversing said main chamber and thence successively back and forth between said intermediate and said front chambers, whereby the viscous fluid is heated in said main chamber by the heating medium flowing around said external tubes and flowing in said first clearance spaces;

outlet means in said main chamber for discharge of spent heating medium, and discharge means in said front chamber for the heated viscous fluid;

said partition means being arranged in said front and said intermediate chamber so that the number of said external tubes and associated heating elements therein is successively reduced in said sections, thereby taking into account the decreased viscosity of the viscous fluid as it is successively heated in said sections.

2. The heat exchanger as claimed in claim 1, wherein the number of external tubes in each said section is proportional to the viscosity of the heated viscous fluid.

3. The heat exchanger as claimed in claim 1, wherein said outlet means in the additional tubes is constituted by a succession of holes in each tube at the bottom thereof, said holes being inclined with respect to the longitudinal axis of the associated tube so as to be tilted away from the associated second plug means.

4. The heat exchanger as claimed in claim 3, wherein said holes from an angle of between 60° and 80° with the longitudinal axis of the associated tube.

5. The heat exchanger as claimed in claim 1, further comprising radial fins on said internal tubes to facilitate the heat exchange.

6. The heat exchanger as claimed in claim 1, wherein said successive sections have the successively reduced number of the external tubes in a direction from said inlet means to said discharge means of the front chamber.

* * * * *